US006547036B1

(12) United States Patent
Carter

(10) Patent No.: US 6,547,036 B1
(45) Date of Patent: Apr. 15, 2003

(54) LADDER LEG SUPPORT APPARATUS

(75) Inventor: Boyce N. Carter, 2000 Clearview Dr., LaGrange, KY (US) 40031

(73) Assignee: Boyce N. Carter, LaGrange, KY (US)

( * ) Notice: Subject to any disclaimer, the term of this patent is extended or adjusted under 35 U.S.C. 154(b) by 0 days.

(21) Appl. No.: 09/832,258

(22) Filed: Apr. 10, 2001

(51) Int. Cl.[7] ..... E06C 7/44
(52) U.S. Cl. ..... 182/200
(58) Field of Search ..... 182/200, 45, 107, 182/108; 248/237

(56) References Cited

U.S. PATENT DOCUMENTS

| | | | | |
|---|---|---|---|---|
| 992,253 A | * | 5/1911 | Richardson | |
| 4,069,893 A | | 1/1978 | Blackstone | |
| 4,304,318 A | | 12/1981 | Webb | |
| 4,699,247 A | | 10/1987 | Clarke | |
| 4,842,229 A | * | 6/1989 | Murray | 182/45 |
| 5,249,397 A | * | 10/1993 | Monacy | 182/45 |
| 5,615,752 A | | 4/1997 | Wassil | |
| 5,791,438 A | | 8/1998 | Kempton | |
| 5,975,471 A | | 11/1999 | Dishman | |
| 6,044,929 A | | 4/2000 | Wishner | |
| 6,053,284 A | | 4/2000 | Fountain | |

FOREIGN PATENT DOCUMENTS

| | | | |
|---|---|---|---|
| FR | 2663075 | * 12/1991 | 182/107 |
| GB | 2057040 | * 3/1981 | 182/108 |
| GB | 2244506 | * 12/1991 | 182/108 |

* cited by examiner

*Primary Examiner*—Alvin Chin-Shue

(57) ABSTRACT

A ladder leg support apparatus includes a support member having upstanding inner side and back walls and inclined outer side and back walls. Flanges selectively positioned along the inner side walls support a plate at a selected height for supporting a ladder leg thereon. An auxiliary side panel is pivotally coupled to an outer side wall and may be extended and supported with a support leg to provide stability when the support member is positioned on a stair. The apparatus further includes a platform having a support surface on which the support member may be positioned. The platform includes threaded leg assemblies which may be extended to a downwardly adjacent stair to support the platform on a selected stair. The platform includes at least one sight level for verifying the proper support leg length adjustment.

15 Claims, 4 Drawing Sheets

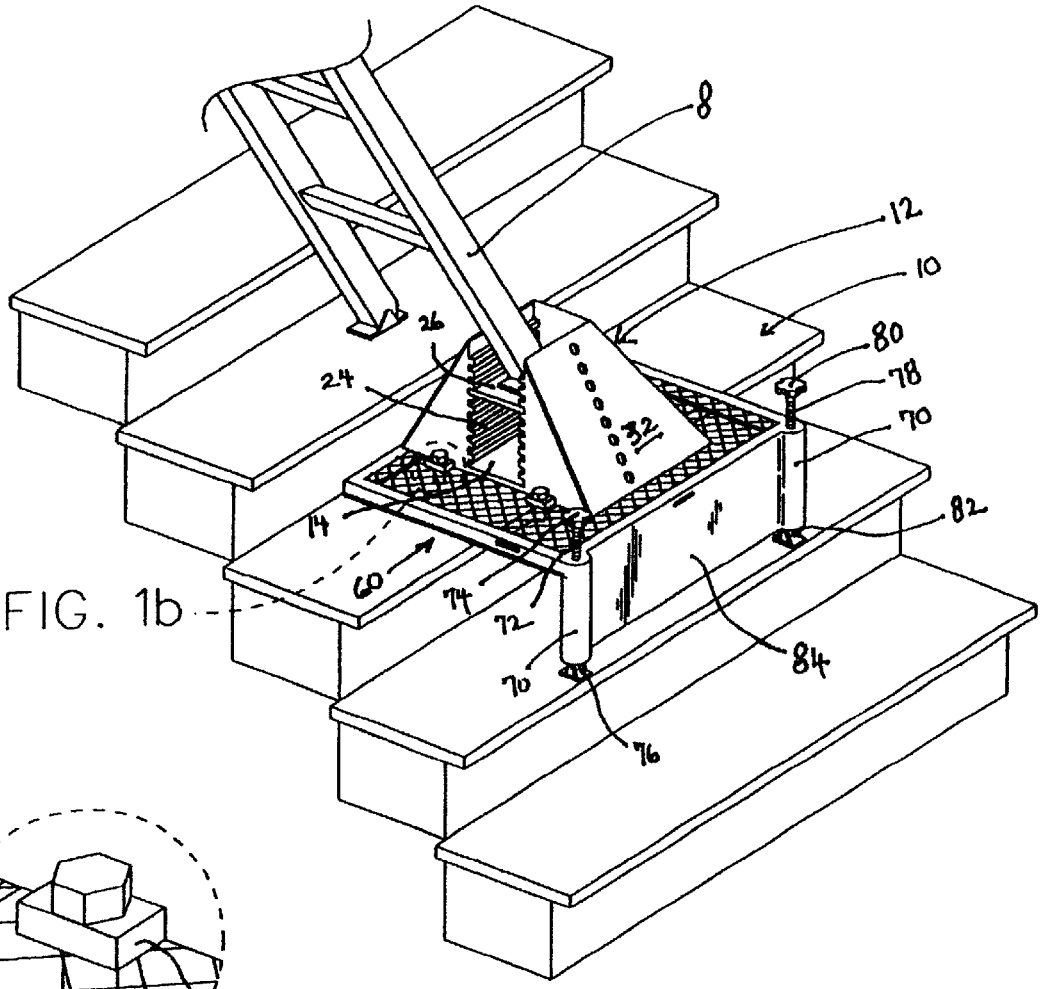
FIG. 1b
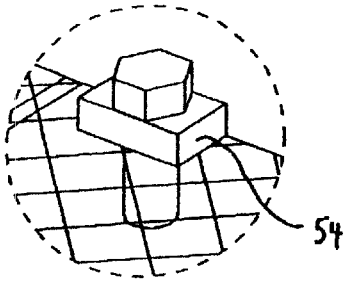
FIG. 1b
FIG. 1a 68
92
66

60
68
62
90
84

64
68
66
80
78
62
70
66
84
82

74
72

70
76

LADDER LEG SUPPORT APPARATUS

BACKGROUND OF THE INVENTION

This invention relates generally to ladder leveling devices and, more particularly, to an apparatus for supporting the leg of a ladder and for stabilizing the supporting member on a stairway.

Workers who use ladders are frequently faced with placing a ladder on uneven ground or even on stairs. When the legs of a ladder are uneven, workers sometimes resort to the use of bricks, boards, cement blocks, or whatever else is handy to augment the length of one of the legs. Obviously, this type of adjustment leads to an unstable and unsafe work environment which could, and sometimes does, result in serious injury.

Various devices have been proposed for leveling the legs of a ladder in the context of an uneven ground or support surface. Although assumably effective for their intended purposes, existing devices often require a ladder to be permanently modified to accommodate the device and often do not provide assurance that the ladder is level following adjustment.

Therefore, it is desirable to have an apparatus which adjustably supports a leg of a ladder a selectable distance above a support surface. Further, it is desirable to have an apparatus which includes a platform for stabilizing the ladder leg support member upon the stairs of a stairway. Finally, it is desirable to have an apparatus which includes a sight level for verifying that the stabilizing platform itself is level.

SUMMARY OF THE INVENTION

A ladder leg support apparatus according to this invention includes a support member having a truncated tetrahedral configuration with a base plate, upstanding inner side and back walls, and inclined outer side and back walls. The inner side and back walls define an interior space and an open front and open top. A plurality of opposed support flanges along the inner side walls allow a support plate to be selectably positioned a selected distance above the base plate. In turn, the support plate is adapted to support a ladder leg thereon. The support member further includes at least one auxiliary side panel pivotally coupled to an outer side wall. The auxiliary side panel includes a plurality of threaded apertures in which a support leg may be positioned when the auxiliary side panel is pivoted to a configuration coextensive with the base plate. The support leg is threadably adjustable such that the support leg may contact the surface of a stair downwardly adjacent a stair on which the support member is placed. This configuration provides stability when a ladder leg is supported atop the support plate.

The apparatus further includes a platform having a support surface which may be positioned upon a selected stair of a staircase and is adapted for supporting the support member thereon. The platform includes a pair of leg assemblies having support legs that are threadably adjustable to contact the surface of a downwardly adjacent stair and thus to stabilize the platform support surface and support member on the selected stair. At least one sight level is mounted to a frame of the platform so that a user may verify that the platform is level following an adjustment of the support legs.

Therefore, a general object of this invention is to provide a ladder leg support apparatus which supports and stabilizes a ladder leg positioned on an uneven support surface.

Another object of this invention is to provide an apparatus, as aforesaid, which distributes the weight load of a ladder and a worker thereon over a broad base assembly.

Still another object of this invention is to provide an apparatus, as aforesaid, that is easily adjustable to support a ladder leg at selectable heights above a support surface.

Yet another object of this invention is to provide an apparatus, as aforesaid, which minimizes the risk of ladder leg slippage.

A further object of this invention is to provide an apparatus, as aforesaid, that is universally usable with two-rail ladders.

A still further object of this invention is to provide an apparatus, as aforesaid, that is constructed of durable materials that are economical to manufacture.

Another object of this invention is to provide an apparatus, as aforesaid, having a sight level for verifying that the platform is level.

Other objects and advantages of this invention will become apparent from the following description taken in connection with the accompanying drawings, wherein is set forth by way of illustration and example, an embodiment of this invention.

BRIEF DESCRIPTION OF THE DRAWINGS

FIG. 1*a* is a perspective view of a ladder leg support apparatus according to a preferred embodiment of the present invention;

FIG. 1*b* is an isolated view of a stabilizer assembly as in FIG. 1*a* on an enlarged scale;

DESCRIPTION OF THE PREFERRED EMBODIMENT

Figures 2A, 2B, 2C:
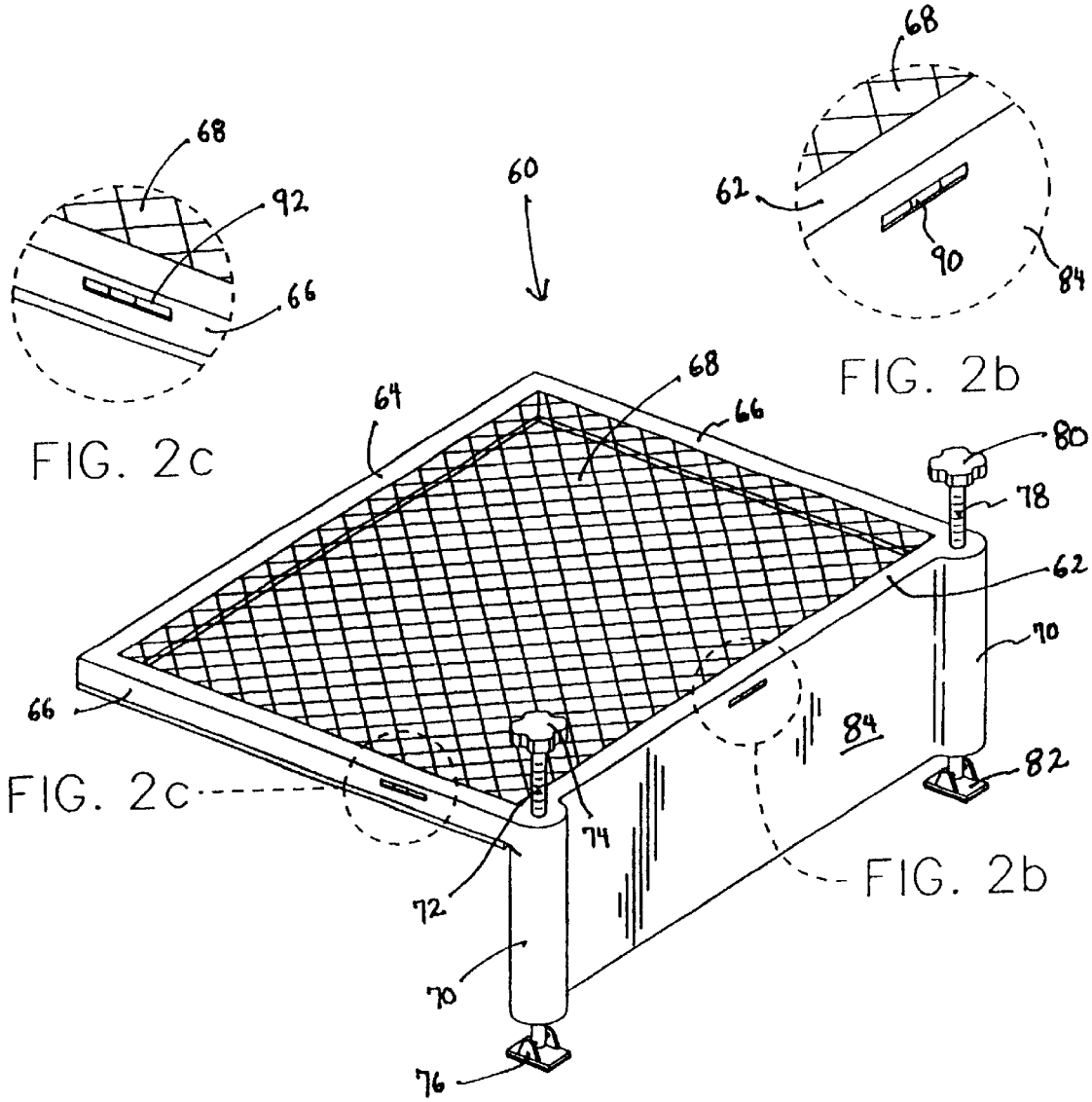
FIG. 2*a* is a perspective view of a platform as in FIG. 1*a;*
FIG. 2*b* is an isolated view of a sight level as in FIG. 2*a* on an enlarged scale.
FIG. 2*c* is an isolated view of another sight level as in FIG. 2*a* on an enlarged scale.

A ladder leg support apparatus 10 according to a preferred embodiment of the present invention will now be described with reference to FIGS. 1*a* through 4 of the accompanying drawings. The ladder leg support apparatus 10 includes a support member 12 having a truncated generally tetrahedral block configuration in which the top portions of each triangular shaped wall is removed (FIG. 1). The support member 12 includes a metal construction although a molded plastic construction would also work. The support member 12 includes a base plate 14 with opposed upstanding inner side walls 16 extending upwardly therefrom. An upstanding inner back wall 20 also extends upwardly from the base plate 14 and is interposed between the inner side walls 16. The inner side and back walls define an interior space in the form of an interior column having an open front and open top. The open front, however, is cut out of an upstanding front wall 30. A plurality of opposed pairs of support flanges 24 or ledges are integrally mounted along the inner side walls 16, each support flange 24 extending between the inner back wall 20 and the open front and being parallel to the base plate 14.

The support member 12 includes a planar support plate 26 which may be selectably and slidably positioned atop selected opposed support flanges 24 and thus spans the interior space. A ladder leg 8 may be supported atop the support plate 26 a selected height above the base plate 14. Therefore, the support member 12 may be placed on one stair with the support plate 26 positioned at the same height as the next upwardly adjacent stair so that both legs of a ladder may be supported at the same height on a stairway (FIG. 1).

Figure 4:
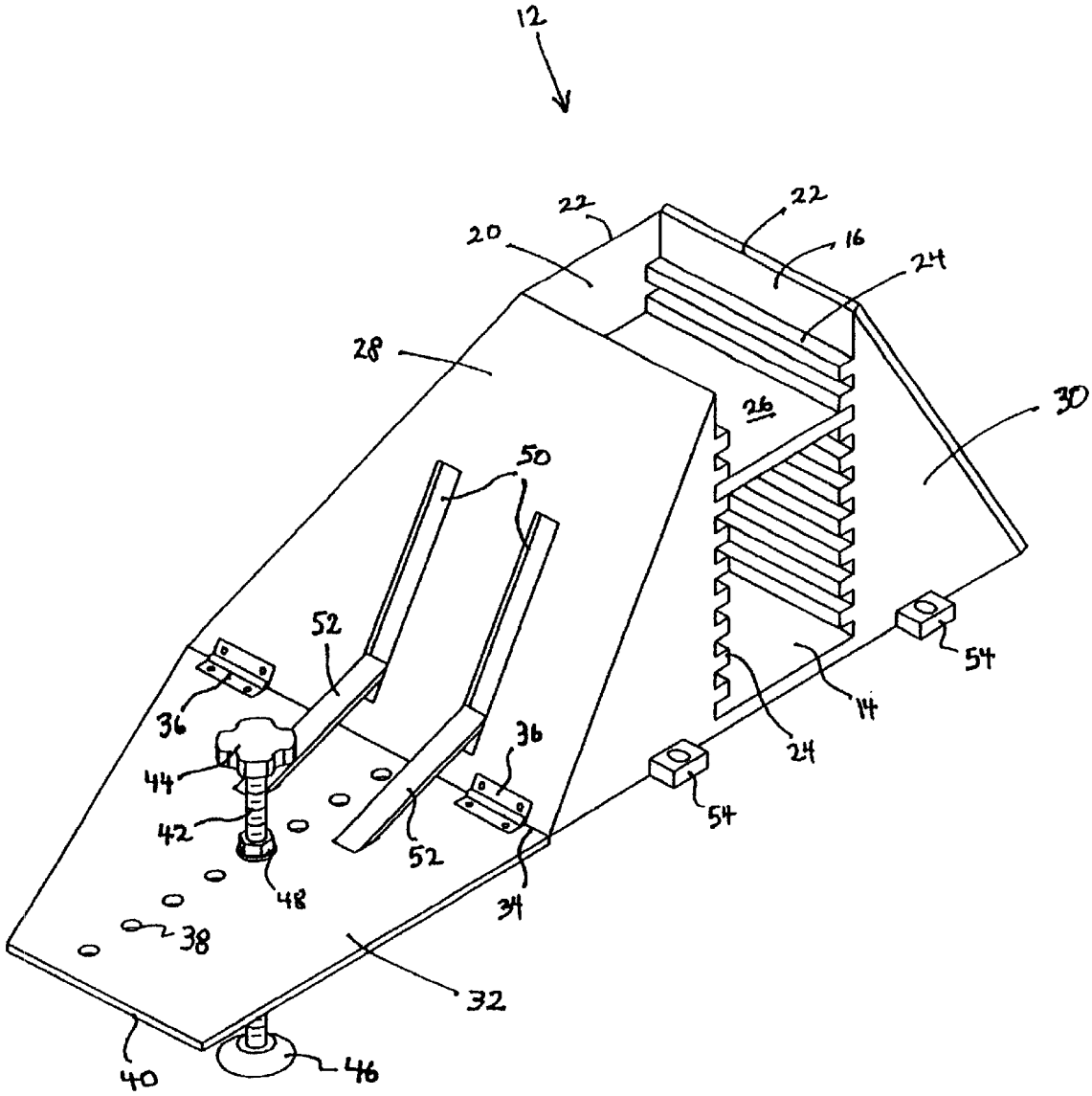
FIG. 4 is an isolated perspective view of a support member with the auxiliary side panel in an extended configuration.

The support member 12 further includes opposed outer side walls 28 that are inclined and extend between respective lateral side edges of the base plate 14 and respective top edges 18 of the inner side walls 16 (FIG. 4). The support member 12 also includes an outer back wall (not shown) also having an inclined configuration extending between a longitudinal edge of the base plate 14 and a top edge 22 of the inner back wall 20. The support member 12 includes at least one auxiliary side panel 32 having a first edge 34 pivotally coupled to a lower edge of a respective outer side wall 28 with hinges 36 (FIG. 4). It is understood that an auxiliary side panel may be coupled to both outer side walls. An auxiliary side panel 32 includes a configuration complementary to the configuration of an outer side wall 28 and may be positioned in a first configuration bearing against and overlaying a respective outer side wall 28. An auxiliary side panel 32 may also be pivotally positioned in a second configuration coextensive with a longitudinal plane defined by the base plate 14 (FIG. 4). In other words, an auxiliary side panel 32 acts as a longitudinal extension of the base plate 14 at its second extended configuration.

Each auxiliary side panel 32 defines a plurality of circular apertures 38 spaced apart between its first edge 34 and an opposed free edge 40. The support member 12 includes a first support leg 42 having a plurality of threads. The first support leg 42 also includes a knob 44 fixedly attached to one end for user rotation of the support leg and a base 46 releasably coupled to an opposed end for contact with a support surface. The first support leg 42 may be rotatably positioned within a selected aperture 38 with nuts 48 or other suitable fasteners such that the leg may be threadably rotated therein increase or decrease the length of the leg depending from the auxiliary side panel 32 and thus the height of the auxiliary side panel 32 above a support surface upon which the base 46 is in contact.

Each outer side wall 28 includes a pair of spaced apart vertical slots 50 (FIG. 4) and each auxiliary side panel 32 defines a pair of spaced apart recesses (not shown). A pair of locking hinges 52 are pivotally coupled to respective outer side walls 28 at lower extents of respective vertical slots 50. A free end of each locking hinge 52 is configured to mate with a respective recess when a respective auxiliary side panel 32 is at its second extended configuration and may be released by a user to be received in an upper extent of a slot 50 at a first configuration of the auxiliary side panel 32. At the second configuration, the locking hinges 52 provide added stability to the auxiliary side panel 32 when a ladder leg 8 is being supported by the support plate 26.

The support member 12 further includes a plurality of spaced apart stabilizer flanges 54 fixedly attached to longitudinal edges of the base plate 14 (FIG. 4). Each stabilizer flange 54 defines a circular opening through which a fastener such as a bolt, pin, screw, or the like may be inserted for coupling the support member 12 to a platform 60 (FIG. 1*b*), as to be described more fully below.

The apparatus 10 includes a platform 60 having front 62 and rear 64 longitudinal frame members with side frame members 66 extending therebetween, the frame members being arranged in a generally rectangular configuration (FIG. 2*a*). A support surface 68 is encased by the frame members 62, 64, 66 and spans therebetween. Preferably, the support surface 68 is a grate (FIG. 2*a*) although a solid metal, wood, or durable plastic surface would also be suitable. A pair of upstanding cylindrical housings 70 are integrally attached to the front frame member 62 at its intersection with respective side frame members 66. Each housing 70 presents a threaded bore for receiving second 72 and third 78 support legs therethrough, each leg having a plurality of threads complementary to those within the bore. The second 72 and third 78 support legs include respective knobs 74, 80 fixedly attached at one end so that a user can rotate each leg as desired. A foot 76, 82 is pivotally attached at respective opposed ends for contacting a support surface, such as the surface of a stair of a stairway. Gripping members, such as rubber treads, may be attached to the underside of each foot for enhanced grip to minimize slippage. Therefore, as the second 72 and third 78 support legs are rotated, the height of the frame members above the support surface in contact with respective feet is increased or decreased.

A front wall 84 integrally depends from the front frame member 62 and extends between the housings 70. A conventional bubble sight level 90 is mounted on the front wall 84 such that a user can verify that at least the front frame member 62 is level following adjustment of the second 72 and third 78 support legs (FIG. 2*b*). Additional sight levels 92 may be mounted on the side frame members 66 as well such that a user can determine if the side frame members 66 are level or if additional leg adjustments are needed (FIG. 2*c*).

Figure 3:
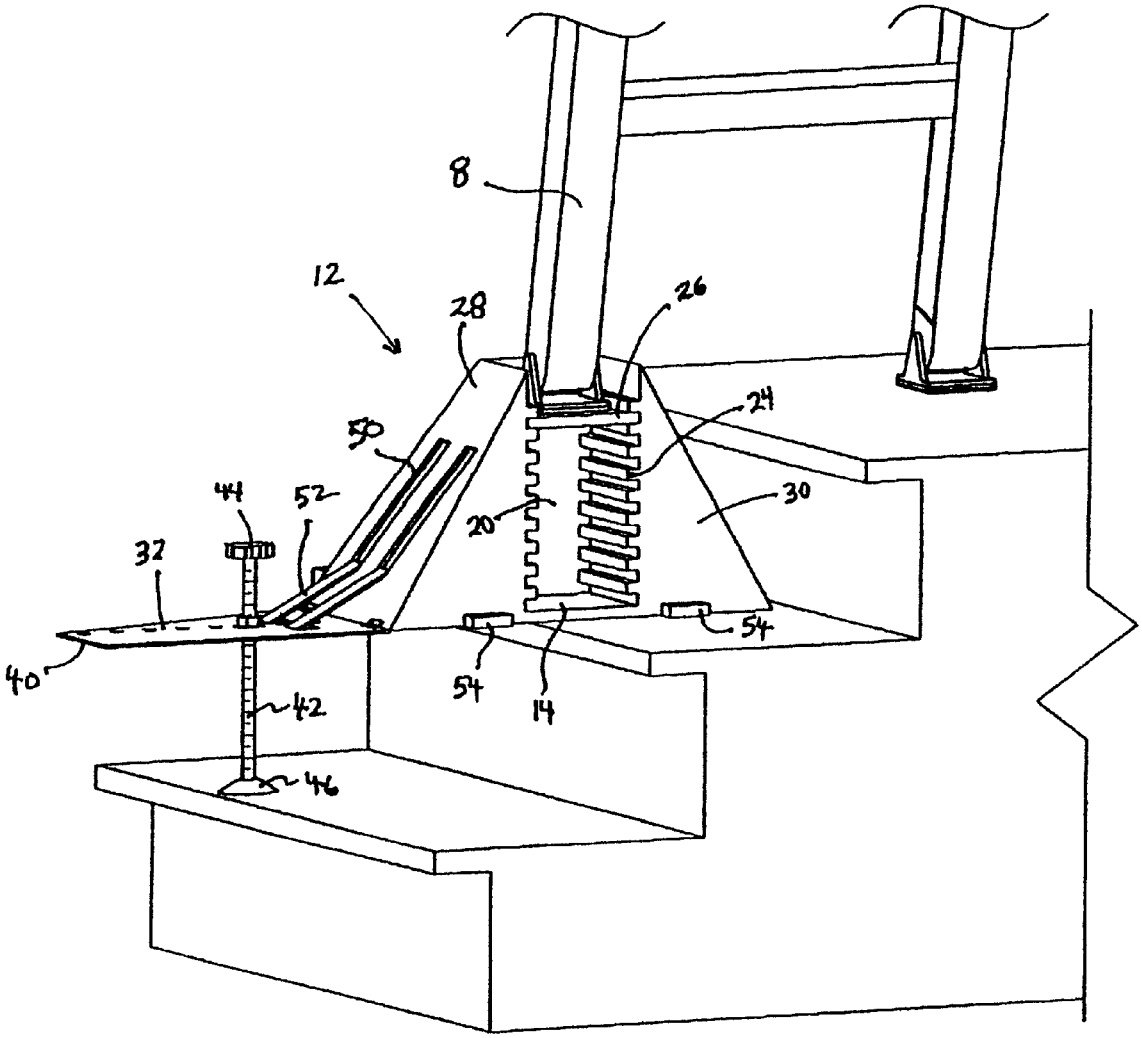
FIG. 3 is perspective view of the apparatus as in FIG. 1*a* with the auxiliary side panel in an extended configuration.

In use, the support member 12 may be positioned directly on a stair (FIG. 3) or atop a platform 60 that is positioned on a stair (FIG. 1*a*). In the first case, the base plate 14 is positioned on the downwardly adjacent stair relative to the selected stair upon which a ladder is to be placed (FIG. 3). Further, the support member 12 is oriented such that the open front is facing the stair's side edge with an outer side wall 28 facing the downward path of the stairway. The support plate 26 is positioned atop appropriate opposed support flanges 24 so as to be level with the surface of the next upwardly adjacent stair. An auxiliary side panel 32 may be pivotally opened to the second extended configuration and the first support leg 42 may be threadably positioned within a selected aperture 38 by rotating the knob 44 so as to support the auxiliary side panel 32 above the stair downwardly adjacent the stair upon which the base plate is supported (FIG. 3). The free ends of the locking hinges 52 may be engaged with the recesses for additional stability. The legs of a ladder may then be securely supported upon a selected stair and the support plate 26 of the now properly configured support member 12 (FIG. 3).

In the second instance (FIG. 1*a*), the support member 12 is supported atop the support surface 68 of the platform 60 (FIG. 1*a*). The rear 64 and side 66 frame members of the platform 60 itself are positioned atop the surface of the next downwardly adjacent stair relative to the stair selected to support a ladder. The side frame members 66 are of a length such that the leg housings 70 depending from the front frame member 62 are positioned over the second downwardly adjacent stair relative to the selected stair. User rotation of the knobs 74, 80 causes the second 72 and third 78 support legs to extend downwardly until the feet 76, 82 contact that second downwardly adjacent stair. The sight levels 90, 92 enable a user to determine if the second 72 and third 78 support legs have been adjusted an equal amount and if they need to be rotated even further, respectively. Once the platform 60 is determined to be level, the support member 12 may be placed thereon and the support plate 26 may be selectively positioned atop appropriate support flanges 24 so that it is level with the selected stair. The support member 12 may be secured to the support surface 68 with the stabilizer flanges 54 to prevent undesired movement therealong (FIG. 1*b*). The legs of a ladder may then be supported atop the selected stair and the support plate 26.

The auxiliary side panel 32 may be utilized even in the FIG. 1*a* instance for additional support, especially where the first support leg 42 is long enough to extend to the third downwardly adjacent stair relative to the selected stair (not shown). It should be appreciated that the platform 60 may be used without the support member 12 so long as the support surface 68 is positioned atop the selected stair and the distance between the front 62 and rear 64 frame members is at least equal to the distance between the ladder legs.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A ladder leg support apparatus for supporting a ladder on a stairway, said apparatus comprising:

a support member having a base plate, opposing upstanding inner side walls extending from said base plate, and an upstanding inner back wall extending from said base plate intermediate said inner side walls, said inner side walls and said inner back wall defining an interior space with an open top and an open front;

a plurality of opposed pairs of support flanges positioned along said inner side walls;

a support plate selectably positioned atop corresponding support flanges and adapted to support a leg of a ladder at a selected height above said base plate of said support member;

said support member comprising:

opposed outer side walls, each outer side wall being inclined and extending between a respective side edge of said base plate and a top edge of a respective inner side wall;

an outer back wall being inclined and extending between a longitudinal edge of said base plate and a top edge of said inner back wall;

an auxiliary side panel having a first edge pivotally coupled to a lower edge of a respective outer side wall for pivotal movement between a first configuration bearing against said respective outer side wall and a second configuration coextensive with a longitudinal plane defined by said base plate, said auxiliary side panel defining a plurality of apertures; and a support leg having a plurality of threads and a base for contact with a support surface, said support leg adapted to be threadably positioned in a selected aperture, whereby a rotation of said support leg in one direction increases the length of said support leg depending from said auxiliary side panel to increase the height of said auxiliary side panel relative to the support surface, a rotation of said support leg in an opposed direction decreases the length of said support leg depending from said auxiliary side panel to decrease the height of said auxiliary side panel relative to the support surface.

2. The apparatus as in claim 1 wherein a respective outer side wall defines a pair of parallel vertical slots and said auxiliary side panel defines a pair of spaced apart recesses, said apparatus further comprising a pair of locking hinges pivotally coupled to said respective outer side wall in lower extents of respective vertical slots, said locking hinges having free ends adapted to releasably mate with respective recesses at said second configuration of said auxiliary side panel and to be received in upper extents of said respective vertical slots at said first configuration of said auxiliary side panel.

3. The apparatus as in claim 1 further comprising:

a platform having a support surface encased by a frame and adapted to rest atop a selected stair of a stairway and to support said support member thereon; and a pair of support legs depending from said frame, each support leg having a foot pivotally coupled thereto for contacting the surface of a stair downwardly adjacent to said selected stair, said support legs being threadably adjustable relative to said frame for selectably increasing or decreasing the height of said frame above said adjacent stair surface.

4. The apparatus as in claim 3 further comprising a plurality of stabilizer assemblies, each stabilizer assembly including a flange fixedly attached to said support member and a fastener adapted to extend through said flange and through said support surface of said platform, whereby to preclude movement of said support member along said support surface.

5. The apparatus as in claim 3 further comprising at least one sight level mounted to said frame so that the level of said support surface may be verified.

6. The apparatus as in claim 3 wherein said support surface is a grate.

7. A ladder leg support apparatus for supporting a ladder on a stairway, said apparatus comprising:

a support member having truncated tetrahedral configuration including a base plate, opposed inner side walls extending upwardly from said base plate, and an inner back wall extending upwardly from said base plate intermediate said inner side walls, said inner side walls and said inner back wall defining an interior space with an open top and an open front;

said support member having opposed outer side walls, each outer side wall being inclined and extending between a respective side edge of said base plate and a top edge of a respective inner side wall;

said support member having an outer back wall, said outer back wall being inclined and extending between a longitudinal edge of said base plate and a top edge of said inner back wall;

a plurality of opposed pairs of support flanges positioned along said inner side walls, each pair of support flanges being parallel to said base plate;

a support plate selectably positioned atop corresponding support flanges and adapted to support a leg of a ladder at a selected height within said interior space and above said base plate of said support member;

a platform having a generally rectangular frame with a support surface spanning said frame, said support surface adapted to rest atop a selected stair of a stairway and to support said support member thereon;

a pair of support legs depending from said frame, each support leg having a foot pivotally coupled thereto for contacting the surface of a stair downwardly adjacent to said selected stair, said support legs being threadably adjustable relative to said frame for selectably increasing or decreasing the height of said frame above said adjacent stair surface;

an auxiliary side panel having a first edge pivotally coupled to a lower edge of a respective outer side wall for pivotal movement between a first configuration bearing against said respective outer side wall and a second configuration coextensive with a longitudinal plane defined by said base plate, said auxiliary side panel defining a plurality of apertures; and another support leg having a plurality of threads and a base for contact with a support surface, said another support leg adapted to be threadably positioned in a selected aperture, whereby a rotation of said another support leg in one direction increases the length of said another support leg depending from said auxiliary side panel to increase the height of said auxiliary side panel relative to the support surface, a rotation of said another support leg in an opposed direction decreasing the length of said another support leg depending from said auxiliary side panel to decrease the height of said auxiliary side panel relative to the support surface.

8. The apparatus as in claim 7 further comprising a pair of leg housings fixedly attached to said frame, each leg housing defining a threaded bore; and wherein each support leg includes a plurality of threads complementary to a respective threaded bore such that a rotation of said support leg in one direction therein increases the length of said support leg depending from said respective leg housing so as to increase the height of said frame relative to the surface of said downwardly adjacent stair, and a rotation of said support leg in an opposed direction decreases the length of said support leg depending from said respective leg housing so as to decreases the height of said frame relative to the surface of said downwardly adjacent stair.

9. The apparatus as in claim 7 wherein length and width dimensions of said support surface are greater than corresponding length and width dimensions of said base plate of said support member such that said support member is securely supported atop said support surface.

10. The apparatus as in claim 7 wherein said support surface is a grate.

11. The apparatus as in claim 10 further comprising a plurality of stabilizer assemblies, each stabilizer assembly including a flange fixedly attached to said support member and a fastener adapted to extend through said flange and through said grate, whereby to preclude movement of said support member along said grate.

12. The apparatus as in claim 7 further comprising a plurality of stabilizer assemblies, each stabilizer assembly including a flange fixedly attached to said support member and a fastener adapted to extend through said flange and through said support surface of said platform, whereby to preclude movement of said support member along said support surface.

13. The apparatus as in claim 7 further comprising at least one sight level mounted to said frame.

14. The apparatus as in claim 7 wherein a respective outer side wall defines a pair of parallel vertical slots and said auxiliary side panel defines a pair of spaced apart recesses, said apparatus further comprising a pair of locking hinges pivotally coupled to said respective outer side wall in lower extents of respective vertical slots, said locking hinges having free ends adapted to releasably mate with respective recesses at said second configuration of said auxiliary side panel and to be received in upper extents of said respective vertical slots at said first configuration of said auxiliary side panel.

15. The apparatus as in claim 7 wherein said auxiliary side panel is pivotally coupled to said respective outer side wall with a pair of hinges.

* * * * *